US010640337B2

(12) United States Patent
Eberhardt et al.

(10) Patent No.: US 10,640,337 B2
(45) Date of Patent: May 5, 2020

(54) CRANE AND COUNTERWEIGHT FOR A CRANE

(71) Applicant: Liebherr-Werk Ehingen GmbH, Ehingen (DE)

(72) Inventors: Lars Eberhardt, Staig (DE); Peter Scheffold, Öchsenhausen (DE)

(73) Assignee: Liebherr-Werk Ehingen GmbH, Ehingen (DE)

( * ) Notice: Subject to any disclaimer, the term of this patent is extended or adjusted under 35 U.S.C. 154(b) by 277 days.

(21) Appl. No.: 15/695,091

(22) Filed: Sep. 5, 2017

(65) Prior Publication Data

US 2018/0155162 A1 Jun. 7, 2018

(30) Foreign Application Priority Data

Sep. 5, 2016 (DE) ..... 20 2016 005 419 U
Aug. 8, 2017 (DE) ..... 10 2017 117 958

(51) Int. Cl.

| | |
|---|---|
| ***B66C 23/36*** | (2006.01) |
| ***B66C 23/74*** | (2006.01) |
| ***B66C 23/62*** | (2006.01) |
| ***B66C 23/82*** | (2006.01) |

(52) U.S. Cl.

CPC ..... *B66C 23/365* (2013.01); *B66C 23/62* (2013.01); *B66C 23/74* (2013.01); *B66C 23/82* (2013.01)

(58) Field of Classification Search

CPC ..... B66C 23/365; B66C 23/62; B66C 23/74; B66C 2700/0371; B66C 23/82

See application file for complete search history.

(56) References Cited

U.S. PATENT DOCUMENTS

| | | | | |
|---|---|---|---|---|
| 7,896,316 | B2 * | 3/2011 | Willim | B66C 23/62 254/323 |
| 8,113,363 | B2 * | 2/2012 | Wimmer | B66C 23/54 212/299 |
| 2012/0118846 | A1 * | 5/2012 | Schroder | B66C 23/62 212/179 |
| 2017/0355576 | A1 * | 12/2017 | Kolb | B66C 23/74 |
| 2018/0022586 | A1 * | 1/2018 | Koenig | B66C 23/84 212/197 |

FOREIGN PATENT DOCUMENTS

| | | |
|---|---|---|
| DE | 299 24 477 U1 | 7/2003 |
| DE | 20 2013 008 486 U1 | 10/2013 |
| EP | 2 423 149 A1 | 2/2012 |

* cited by examiner

*Primary Examiner* — Sang K Kim
*Assistant Examiner* — Nathaniel L Adams
(74) *Attorney, Agent, or Firm* — Dilworth & Barrese, LLP

(57) ABSTRACT

This invention relates to a crane comprising an undercarriage and a turntable rotatable with respect to the undercarriage with a counterweight and a mounting point for the attachment of a winch, wherein the counterweight includes at least one winch pick-up means for the temporary attachment of a winch to be mounted on the turntable, wherein the winch can be attached to the winch pick-up means such that the winch can be pivoted about a vertical axis.

15 Claims, 6 Drawing Sheets

CRANE AND COUNTERWEIGHT FOR A CRANE

BACKGROUND OF THE INVENTION

This invention relates to a crane, in particular to a mobile crane, comprising an undercarriage and a turntable rotatable with respect to the undercarriage, which can be ballasted with a counterweight and includes a mounting point for the attachment of a winch, in particular of an auxiliary hoisting gear.

Mobile cranes regularly are at least partly demounted for road transport, in order to separately move individual components to the construction site. This is necessary to comply with the prescribed axle loads. Furthermore, it can be provided to attach certain crane components, such as e.g. a hoisting gear, to the crane only as needed. Up to now, such auxiliary hoisting gear has been mounted by the crane itself, i.e. the auxiliary hoisting gear is picked up by the hoisting cable of the crane and lifted to the desired mounting position of the turntable.

In the known mounting methods the auxiliary hoisting gear therefor was first deposited on the counterweight and the crane turntable subsequently was rotated into the desired position, in order to align its mounting points with the auxiliary hoisting gear. In the next step, the auxiliary hoisting gear was lifted to the required mounting height on the crane turntable by means of the ballasting cylinders of the counterweight. This method, however, was found to be unsuitable for novel crane constructions with variable ballast radius, as a larger dimensioned steel construction of the crane turntable is employed. During the rotary movement of the crane turntable collisions with the auxiliary hoisting gear deposited on the counterweight can occur here.

Another disadvantage of this method consists in that the very strong ballasting cylinders have lifted the entire ballast with the auxiliary hoisting gear deposited thereon and have urged the same against a stop. When pressing up further, the auxiliary hoisting gear then has swiveled into the bolting position. Due to inattention (pressing up the ballasting cylinders too much or forgotten timber under the winch of the auxiliary hoisting gear) the auxiliary hoisting gear might disproportionately be pressed against the steel construction of the turntable. For this reason, all involved components of the steel construction as a precaution have been designed for this overload situation caused by operating errors, i.e. the components must be dimensioned very strong and very heavy.

SUMMARY OF THE INVENTION

The object of the present invention is to be seen in indicating a solution for the self-assembly of a winch, in particular of an auxiliary hoisting gear.

This object is solved by a method according to the features herein. Advantageous aspects of the crane and method are also the subject-matter herein.

According to the invention, there is proposed a generic crane whose counterweight is equipped with at least one winch pick-up means for the temporary attachment of a winch to be mounted on the turntable. This winch pick-up means serves for the transitional attachment of the winch to be mounted during the individual mounting steps. The winch pick-up means is designed such that the winch attached thereto is pivotable with respect to the counterweight about a vertical axis. Due to this possibility the winch initially can be placed on the counterweight outside the radius of rotation of the turntable. Via the swivel axis, however, the winch later on can be pivoted into its mounting position, in which it can easily be attached to the crane turntable.

The swivel bearing can be part of the winch pick-up means. It is also conceivable that the components of the swivel bearing are distributed on the winch pick-up means and the winch to be received, i.e. the winch pick-up means provides for a pivotable support of the winch.

According to a particularly preferred aspect of the invention the winch pick-up means of the counterweight comprises an extendable tube which can be pushed out upwards in vertical direction from the upper side of the counterweight. The extendable tube is equipped with suitable fastening points for accommodating or fastening the respective winch. What is conceivable is the design as telescopable tube, wherein the tube can be fixed, in particular be bolted, in the extended position. When not in use, the extendable tube ideally can be recessed in the counterweight completely or at least in part.

According to a concrete advantageous aspect of the invention, the winch can include a counter-tube which on its end face is designed with a corresponding cylindrical protrusion that can be put into a corresponding opening or bore of the extendable tube of the winch pick-up means. The protrusion hence forms the axis of the formed swivel bearing.

It is conceivable to design the extendable tube and/or the counter-tube of the winch with corresponding stops, in order to limit the maximum range of rotation of the formed swivel connection at least in one direction. Preferably, one stop per direction of rotation is provided. As the swivel movement mostly is carried out manually by the crane operator, an exactly fitting alignment of the winch in the working position can be ensured by means of the stops. The same applies for the position outside the turntable radius.

One possibility for fixing the swivel bearing optionally can be provided, whereby the bearing for example can be fixed at least in the corresponding working position and/or position outside the turntable radius. What is found to be suitable is a fixation by latching, preferably by means of a latching bolt which engages into a corresponding groove.

The length of the extendable tube can be lockable, e.g. boltable, in order to prevent the tube from being pushed in unintentionally. For safety reasons it can be expedient that the bolts used for this purpose likewise are designed for bolting the winch to the crane turntable. The crane operator thereby is forced to release the bolt connection of the tube for mounting the winch. This ensures that the extendable tube is retracted for starting the crane operation. It is preferred particularly when the extendable tube retracts automatically after releasing the bolts, preferably due to its own weight.

Preferably, one or more ballasting cylinders are provided on the crane turntable to bring the counterweight into a mounting position.

In a preferred aspect of the invention the crane turntable is equipped with at least one, preferably at least two pivotable consoles for accommodating the counterweight. The one or more consoles each are equipped with one or more ballasting cylinders for the self-assembly of the counterweight. The ballasting cylinders and their piston rods can be extended downwards in direction of the undercarriage, in order to accommodate a counterweight deposited on the undercarriage. For this purpose, the counterweight can be provided with one or more piston rod receptacles, in particular on the upper side of the counterweight. The extended piston rods can be hooked into the piston rod receptacles by a lateral swivel movement of the crane turntable, so that due to a subsequent retracting movement of the piston rod the counterweight is lifted. A winch placed on the counterweight hence can likewise be lifted by means of the ballasting cylinders in direction of the fastening points on the crane turntable.

Alternatively, however, the ballasting cylinders can also be attached to the uppercarriage and pull up the entire counterweight. Furthermore, mounting the ballasting cylinders on the undercarriage is imaginable, in order to press up the entire counterweight. The ballasting cylinders also can be arranged on the counterweight itself and be releasably connectable with the uppercarriage, in order to pull themselves and the counterweight towards the uppercarriage. It is also imaginable that the ballasting cylinders are arranged on the counterweight, but support against the undercarriage and press the counterweight away from the undercarriage in direction of the uppercarriage.

The advantage of the invention not only consists in that this solution also is suitable for crane constructions with variable ballast radius, but also in that the hoisting gear lifted by means of the ballasting cylinders is not pressed against a stop and not against the steel construction. The height for example is determined by the fact that the same can/must be higher than the actual mounting position of the auxiliary hoisting gear on the turntable, in order to be able to hook the auxiliary hoisting gear in at the turntable from above. Consequently, the ballasting cylinders can maximally move up against each other, but there is no risk of a damage in the case of inattention. The auxiliary hoisting gear will be swiveled in only at this height and can be mounted on the turntable due to a subsequent downward vertical movement.

Beside the crane according to the invention the present invention likewise relates to a counterweight fora crane according to the present invention. In particular, the counterweight is characterized by the features described above, which relate to the concrete configuration of the counterweight. This includes the incorporation of a corresponding winch pick-up means for pivotally accommodating a winch on the counterweight. The advantages and properties of the corresponding counterweight quite obviously correspond to those advantages and properties as they have already been explained above in detail with reference to the crane according to the invention.

Finally, the present invention relates to a winch, in particular to an auxiliary hoisting gear, for a crane according to the present invention. This winch in particular can temporarily be mounted on a counterweight according to the invention, i.e. the winch can temporarily be pivotally mounted on the winch pick-up means of the counterweight.

Beside the apparatuses according to the invention the present invention likewise relates to a method for mounting a winch on the turntable of a crane according to the present invention. The method according to the invention is composed of several method steps. In a first method step the winch is mounted on the winch pick-up means, wherein the winch is in the initial mounting position outside the radius of rotation of the crane turntable. In particular, mounting of the winch is effected via the actual hoisting gear of the crane, i.e. the crane can automatically pick up the winch and move it into the region of the winch pick-up means.

In a next step the crane turntable is turned into the position for picking up the counterweight. This means that both longitudinal axes of uppercarriage and undercarriage are in alignment. By turning in the uppercarriage, the mounting points for the winch on the uppercarriage at the same time are rotated into the region of the winch. The rotary movement of the crane turntable is easily possible, as the winch mounted on the winch pick-up means is positioned outside the radius of rotation. After turning in the turntable, the winch can be pivoted into its working position for being mounted on the turntable and can be connected with, in particular bolted to the same. These movements preferably can be initiated manually or also be carried out via a suitable drive.

According to an optional aspect of the method it is conceivable that the pivotable consoles for accommodating the counterweight are pivoted after turning in the crane turntable or shortly before reaching the position of the crane turntable turned in. Yet before pivoting the consoles or shortly before reaching the end position of the consoles, the ballasting cylinders are extended to a suitable extent, so that the same, in particular their piston rods, are swiveled in by the subsequent swivel movement of the piston rod receptacles of the counterweight laterally corresponding to the consoles. The counterweight thereby can be lifted or lowered by actuating the ballasting cylinders.

Before pivoting the winch it can be advantageous when the counterweight first is lifted by means of the ballasting cylinders. It is particularly preferred when the counterweight or the winch picked up is lifted to a height slightly above the actual mounting points of the winch on the crane turntable. In this position a swivel movement is ensured without disturbing edges. Moreover, this can be necessary anyway when the winch is hooked in at the crane turntable from above. For this purpose, the winch is lowered by adjusting the ballasting cylinders, until the corresponding hooks of the winch engage into the mounting points of the crane turntable.

According to another advantageous aspect of the method the winch pick-up means or the extendable tube is at least partly recessed within the counterweight after successfully mounting the winch.

At the beginning of the method the tube correspondingly first is telescoped out and fixed, in particular bolted, in the required length. After hooking the winch in at the mounting point the fixations, in particular bolt connections, are released. Ideally, the removed bolts also are used for bolting the winch to the crane turntable. It thereby is ensured that after successfully mounting the winch, the bolts of the telescopable winch pick-up means are released and the same is retracted at the same time. For example, the extendable tube is automatically lowered into the counterweight after releasing the bolt connection, so that a damage of the crane turntable or of the extendable tube during the crane work can be avoided.

BRIEF DESCRIPTION OF THE DRAWINGS

Further advantages and properties of the invention will be explained in detail below with reference to an exemplary embodiment illustrated in the Figures, in which.

DESCRIPTION OF THE PREFERRED EMBODIMENTS

Figure 1:
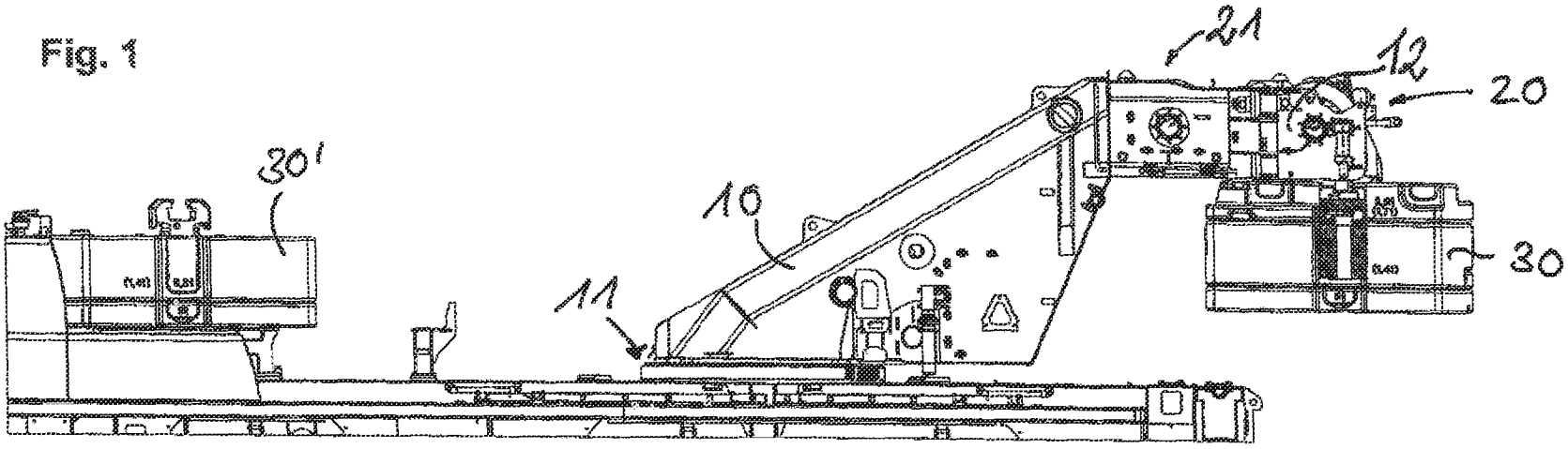
FIG. 1: shows a sketched lateral representation of the crane turntable of the crane according to the invention.

FIG. 1 shows a side view of the crane according to the invention or a detail view of the relevant region around the turntable 10 of the crane. The crane turntable 10 is pivotable with respect to the undercarriage 1 about the vertical axis by means of the slewing ring 11. In addition, at the rear end of the turntable 10 ballast consoles 12 (see FIG. 2) are rotatably mounted, whereby the same likewise are pivotable with respect to the turntable 10 about vertical axes. These consoles 12 serve to hold the counterweight 30 by means of the ballasting cylinders 13.

Furthermore, the crane includes an auxiliary hoisting gear 20 which in addition to the regular hoisting gear 21 can be mounted on the crane turntable 10 behind the main hoisting gear 21 as needed depending on the crane operation. It is required here that in case of need the crane itself can mount the auxiliary hoisting gear 20 without any further aids.

Figure 2:
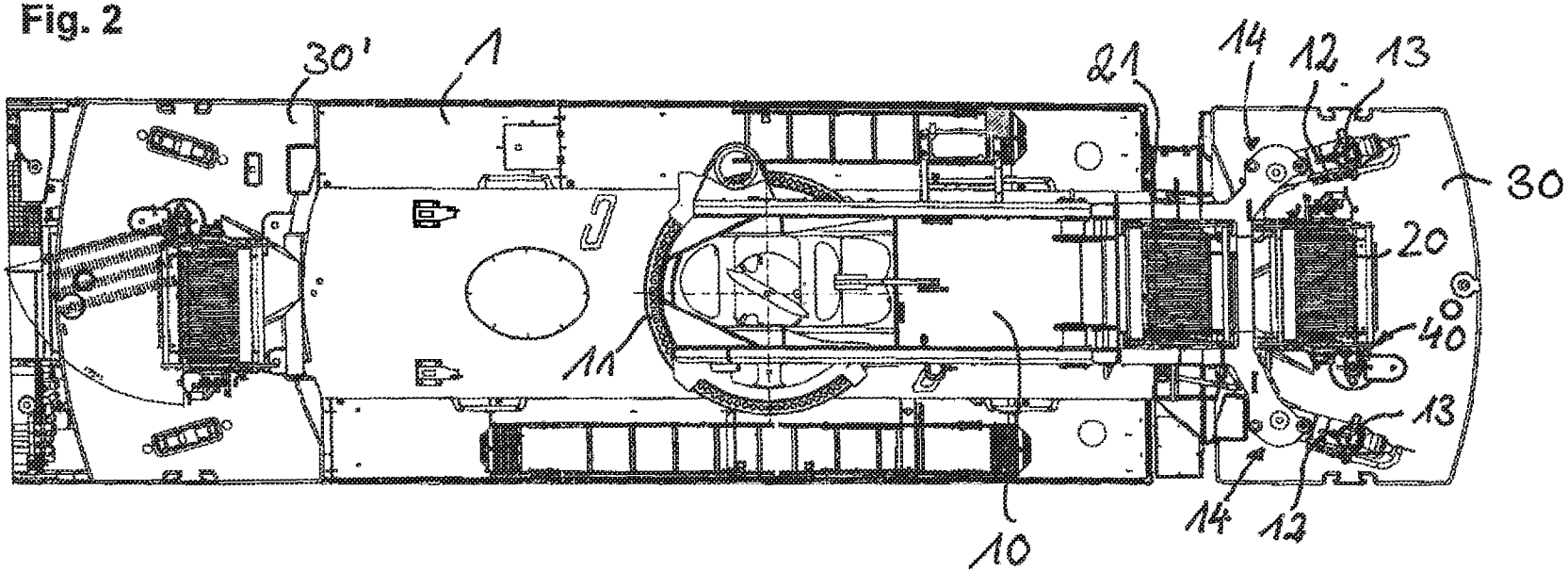
FIG. 2: shows the representation of FIG. 1 in a top view.

In FIGS. 1, 2 the counterweight 30 is drawn two times, once in the position (reference numeral 30) mounted on the crane turntable 10 and once more in the bearing position (reference numeral 30') in front of the turntable 10 on the undercarriage 1. The pivotable support of the consoles 12 allows a more flexible deposition of the counterweight 30 on the undercarriage 1 and possibly a variation of the ballast radius. This construction of the consoles 12, however, means a larger spatial extension of the entire steel construction of the crane turntable 10, whereby its radius of rotation, in particular that of the steel construction, increases.

Would the demounted auxiliary hoisting gear 20 be deposited in the required mounting position on the counterweight 30', the same would lie within the radius of rotation of the crane turntable 10 and the bearing points 14 of the consoles 12 would collide with the deposited auxiliary hoisting gear 20 during a rotary movement of the crane turntable 10.

So far, this problem has not occurred in conventional turntables without the consoles 12. Previous mounting methods therefore provided to first deposit the auxiliary hoisting gear 20 on the counterweight 30' and subsequently pivot the crane turntable 10 rearwards to the hoisting gear for the succeeding assembly. This procedure, however, no longer is practicable for the above reasons. For this reason, the present invention proposes to equip the counterweight 30 with a pivotable winch pick-up means 40. Details on the pick-up means 40 will be explained in detail below with reference to the representations of FIGS. 3*a* to 3*h*. These FIGS. 3*a* to 3*h* show a chronological sequence of the method according to the invention.

Figure 3B:
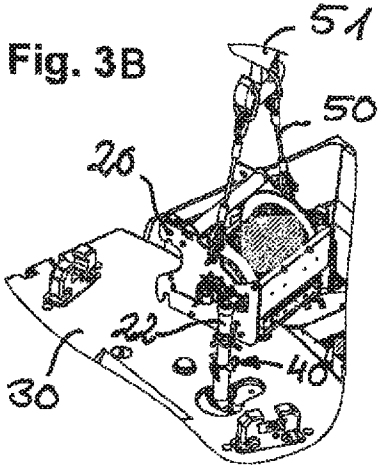
FIGS. 3A-3H: show several detail representations of the mounting process according to the invention for an auxiliary hoisting gear of the crane according to the invention.
Figure 3D:
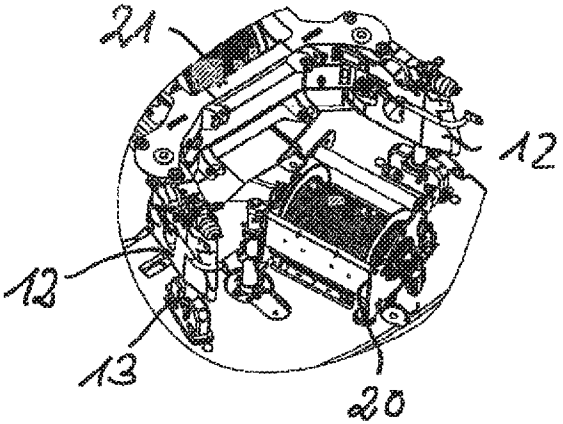
Figure 3A:
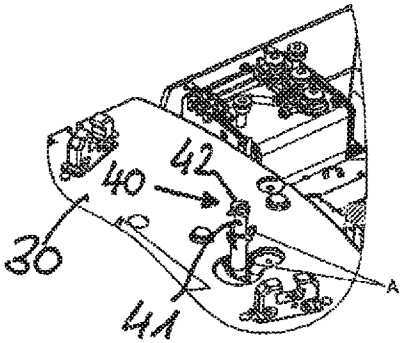
Figure 3C:
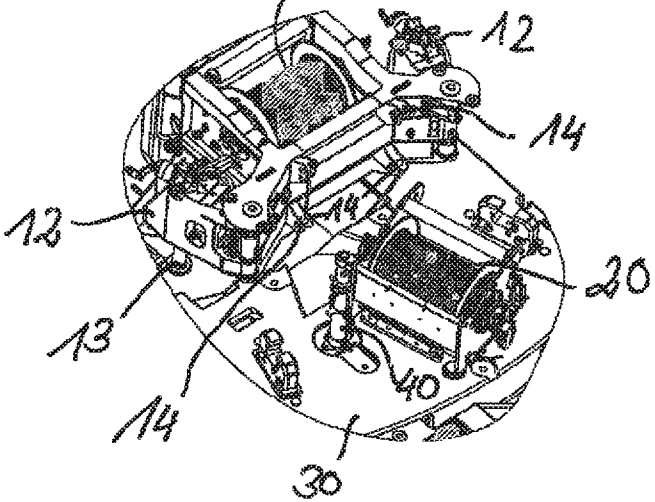

FIG. 3*a* shows a detail view of the counterweight 30, from which a telescopic tube 41 can be extended upwards in vertical direction. On its upper end face the telescopic tube 41 includes a complementary bearing element 42 for the pivotable connection of an appropriate auxiliary hoisting gear 20 with complementary bearing counterpart. For fixing the extension length of the tube 41, the individual sections are fixed by inserting the bolts A.

In the following step according to FIG. 3*b*, the auxiliary hoisting gear 20 initially is picked up via slings 50 of the crane hook 51 of the main hoisting gear 21 and moved into the region of the telescopic tube 41.

Figure 4:
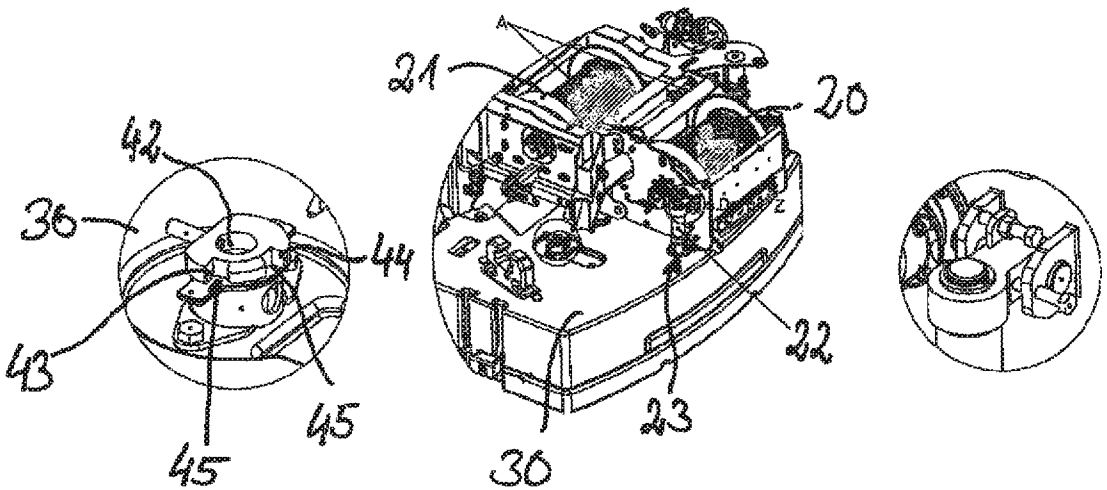
FIG. 4: shows detail views of the bearing points of the auxiliary hoisting gear on the crane turntable or the winch pick-up means.

The auxiliary hoisting gear 20 includes a corresponding counter-tube 22, on whose lower end face a cylindrical protrusion 23 is present (see FIGS. 3*h*, 4), which serves as bearing axis 23 for the swivel bearing of the auxiliary hoisting gear 20 at the pick-up means 40. This protrusion 23 is inserted into the appropriate bore 42 of the extendable tube 41. Subsequently, the slings 50 can be removed. It can be seen that the auxiliary hoisting gear first is positioned at the pick-up means 40 such that the drive shaft of the winch initially lies on the longitudinal axis of the crane almost in parallel, i.e. the winch extends axially away from the crane turntable. The winch thereby lies outside the turntable radius and a possible collision is excluded.

In the next step, the crane turntable 10 now is rotated, so that the consoles 12 and the mounting points 14 for the auxiliary hoisting gear 20 are moved close to the counterweight 30'. Subsequently, the ballasting cylinders 13 are extended (FIG. 3*c*) and the consoles 12 are pivoted rearwards (FIG. 3*d*), so that the ends of the piston rods are swiveled into the corresponding pick-up means 31 of the counterweight 30. Thus, both ballasting cylinders 13 are anchored with the counterweight 30 and the same can be lifted by a retracting movement of the piston rods of the ballasting cylinders 13. At the same time, the auxiliary hoisting gear 20 thereby is lifted to the necessary mounting height. The mounting height for the auxiliary hoisting gear 20 can be higher than the height in which the counterweight 30 is mounted on the turntable 10.

In this position, the auxiliary hoisting gear 20 can unimpededly be pivoted into the mounting position (see FIG. 3*f*) via the telescopic tube 41. As the swivel bearing 42, 23 of the winch pick-up means 40 is fixed in the respective end positions by means of latching bolts 25, the latching bolt 25 first must be released, in order to enable the swivel movement.

Figure 3F:
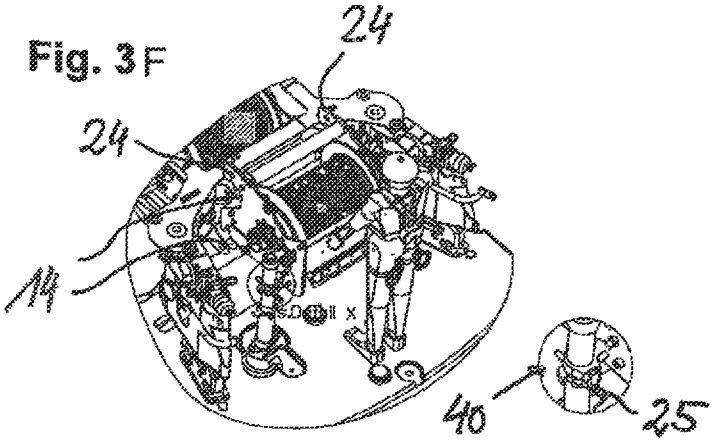
Figure 3E:
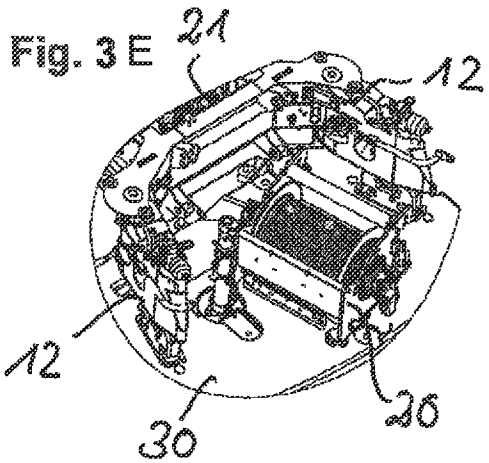
Figure 3H:
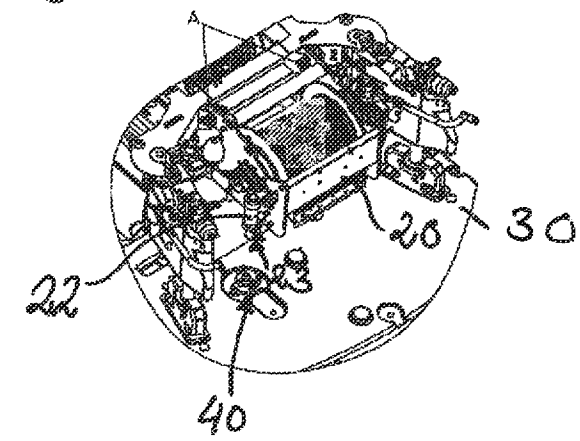

It can be seen in FIG. 3*f* that the hooks 24 of the auxiliary hoisting gear 20 lie slightly above the corresponding mounting points 14 of the crane turntable 10. Hence, all necessary connecting means 24 for mounting the auxiliary hoisting gear 20 on the crane turntable 10 are located directly vertically above their mating connecting means on the turntable 10. For connecting purposes, a vertical movement now exclusively is necessary.

Figure 3G:
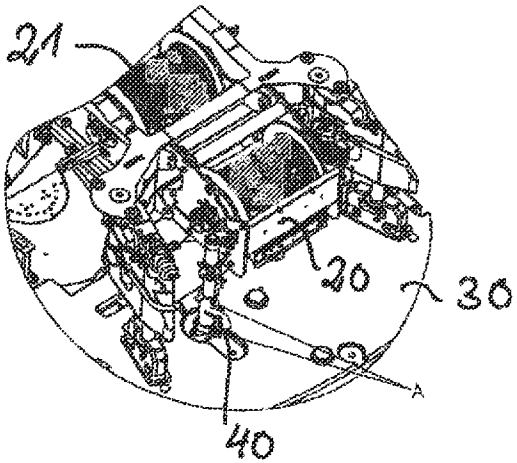
Figure 5:
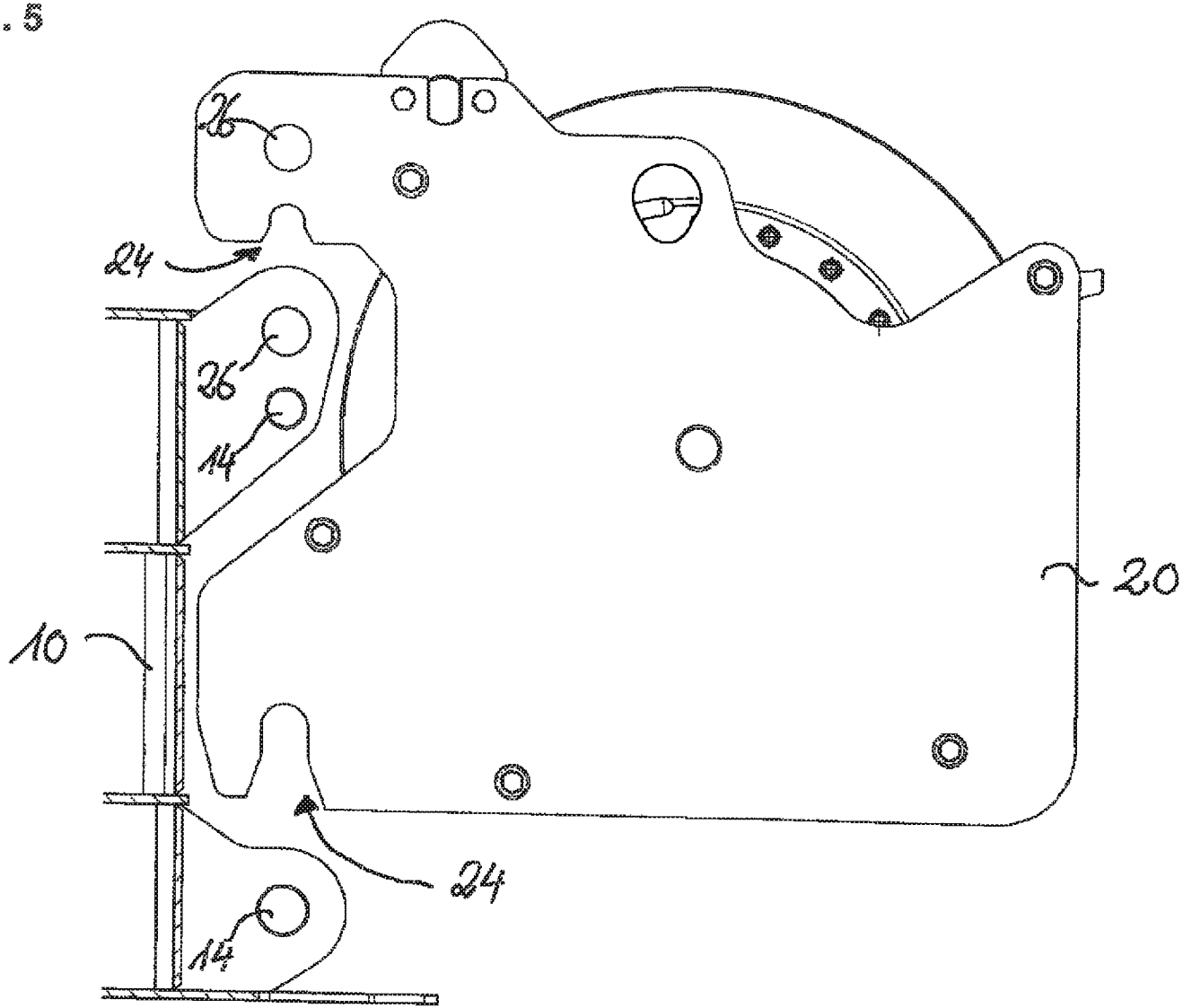
FIG. 5: shows a side view of the auxiliary hoisting gear including the mounting points of the crane turntable.

By extending the cylinders 13, the counterweight 30 according to FIG. 3*g* can be lowered together with the auxiliary hoisting gear 20, whereby the hooks 24 are hooked into the turntable 10 from above. The uppercarriage or the crane turntable 10 thereby takes the weight of the auxiliary hoisting gear 20, whereby the bearing axis 23 is withdrawn from the bore 42 and the winch 20 is separated from the winch pick-up means 40. Subsequently, the bolts of the winch pick-up means 40 can be removed and be used for bolting the auxiliary hoisting gear 20 to the crane turntable 10. The side view of the auxiliary hoisting gear in FIG. 5 shows the hooks 24 provided at the top and at the bottom of the auxiliary hoisting gear, which can be hooked into corresponding firmly installed bolts 14 of the turntable 10. The removed bolts of the winch pick-up means 40 are put into the additional bores 26 of the auxiliary hoisting gear 20. By releasing the bolts of the telescopic tube 41, the same is automatically recessed in the counterweight 30.

FIG. 4 again shows a detail representation of the end-face end of the telescopic tube 41. There can be seen the bore 42 for receiving the bearing axis 23. Furthermore, two stops 43, 44 can be seen as well as corresponding recessed grooves 45. Via the stops 43, 44 the maximum radius of rotation of the auxiliary hoisting gear 20 picked up is limited. The two recessed grooves 45 serve to fix the bearing by means of the latching bolt 25, which engages into the grooves 45 in the respective end positions. To enable the swivel movement, the latching bolt 25 must first be removed.

In the right detail representation, the bearing of the counter-tube 22 on the auxiliary hoisting gear 20 is shown. The counter-tube 22 likewise can be pivotally mounted on the auxiliary hoisting gear 20, in particular about a vertical and/or horizontal axis.

Figure 6:
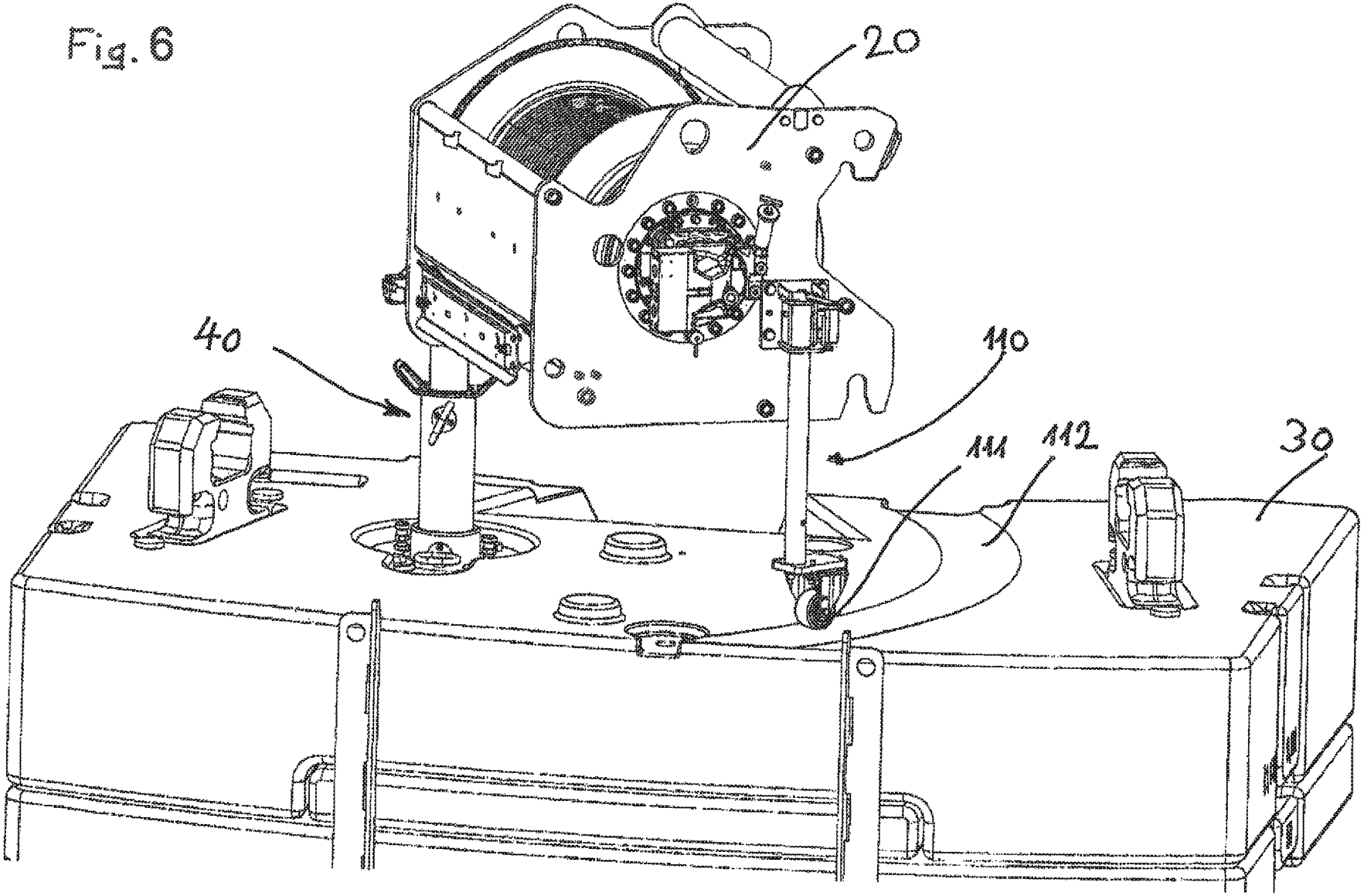
FIG. 6: shows a perspective representation of a particular embodiment of the auxiliary hoisting gear.

FIG. 6 shows a particular embodiment of the auxiliary hoisting gear 20. The auxiliary hoisting gear 20 is held at the winch pick-up means 40. The center of gravity of the auxiliary hoisting gear 20 is relatively further away from the swivel axis and thus causes large bearing forces in the swivel bearing 42, 23. These forces render the swivel movement unnecessarily difficult.

In addition, the distance of the center of gravity of the auxiliary hoisting gear 20 from the swivel axis causes a deflection which impairs the positioning accuracy.

For the solution of this problem a support 110 is provided. The support 110 can comprise a bearing point, in particular a roller 111. The roller 111 can run along a path 112 on the counterweight 30, wherein the path 112 is formed as rolling surface for the roller 111. Here, a sand cover can be provided to form an anti-skid surface or also a reinforcement. The path 112 can have a center which lies on the swivel axis of the auxiliary hoisting gear 20. When the roller 111 is oriented tangentially to a circular path with the center on the swivel axis of the auxiliary hoisting gear 20, a movability of the bearing for the roller 111 even can be omitted.

The invention claimed is:

1. A crane, comprising an undercarriage and a turntable rotatable with respect to the undercarriage with a counterweight and a mounting point for the attachment of a winch, wherein the counterweight includes at least one winch pick-up for temporary attachment of the winch to be mounted on the turntable, and the winch is attachable to the winch pick-up to be pivotable about a vertical axis.

2. The crane according to claim 1, wherein the winch pick-up comprises a swivel bearing.

3. The crane according to claim 1, wherein the winch is pivotable from a position outside the turntable radius into a mounting position of the winch.

4. The crane according to claim 2, wherein the winch pick-up comprises at least one extendable tube with fastening points for releasably mounting the winch, and on an upper side of the counterweight, the tube is extendable in a vertical direction and when not in use, at least partly recessible into the counterweight.

5. The crane according to claim 4, wherein the winch includes a counter-tube which comprises a complementary bearing for pivotally supporting the counter-tube on a bearing of the extendable tube of the counterweight.

6. The crane according to claim 5, wherein the complementary bearing comprises a cylindrical protrusion which is insertable into a bore of an upper end face of the extendable tube, one or more stops are provided on one of the bearings to limit range of rotation, and the respective bearing is fixable via latching in one of limited rotational end regions.

7. The crane according to claim 4, wherein the extendable tube is configured to be bolted in required extended length, and used bolts are also suitable for bolting the winch at the mounting point of the crane turntable.

8. The crane according to claim 1, wherein the winch is an auxiliary hoisting gear.

9. The crane according to claim 1, wherein one or more ballasting cylinders are provided to move the counterweight into a mounting position on the crane turntable, the crane turntable comprises one or more pivotable consoles for accommodating the counterweight, and the one or more consoles include one or more ballasting cylinders which are pivotable into corresponding piston rod receptacles of the counterweight, to lift the counterweight in a vertical direction.

10. A method for mounting a winch on the turntable of a crane, comprising providing the crane of claim 1 and the following steps:

a. mounting the winch on the winch pick-up, wherein the winch is located outside a radius of rotation of the crane turntable, b. turning in the crane turntable, to move fastening points of the crane turntable for the winch into a region of the winch, and c. pivoting the winch into mounting position on the crane turntable via the winch pick-up and mounting the winch on the crane turntable.

11. The method according to claim 10, wherein consoles of the turntable are pivoted after turning in the crane turntable, and ballasting cylinders are extended before pivoting or shortly before reaching a desired pivoted console position, to introduce the same into piston rod receptacles of the counterweight during further pivoting of the consoles.

12. The method according to claim 11, wherein before pivoting the winch into the mounting position, the counterweight is lifted via the ballasting cylinders of the consoles.

13. The method according to claim 11, wherein after pivoting of the winch, the counterweight is lowered via the ballasting cylinders, whereby the winch is hooked in at the mounting point of the crane turntable.

14. The method according to claim 10, wherein an extendable tube of the winch pick-up is bolted in required extension length, and after hooking in the winch at the mounting point, bolts are used for bolting the same.

15. The method according to claim 10, wherein after mounting the winch, the winch pick-up is retracted into the counterweight.

* * * * *